US005894952A

United States Patent [19]

Mendenhall et al.

[11] Patent Number: 5,894,952

[45] Date of Patent: Apr. 20, 1999

[54] SPILL-RESISTANT CUP LID WITH CONDIMENT FUNNEL AND STIRRING ROD

[76] Inventors: Robert Scott Mendenhall; Greg Richard Andrews, both of 1175 Stone Mill Run, S.W., Lawrenceville, Ga. 30245

[21] Appl. No.: 08/988,919

[22] Filed: Dec. 12, 1997

Related U.S. Application Data

[60] Provisional application No. 60/032,727, Dec. 14, 1996.

[51] Int. Cl.[6] ..... A47G 19/22

[52] U.S. Cl. ..... 220/713; 220/717; 220/780; 220/781; 220/212; 215/230; 215/DIG. 5

[58] Field of Search ..... 220/711, 713, 220/717, 718, 780, 781, 794, 212; 215/11.5, 11.6, 228, 230, 387, DIG. 5

[56] References Cited

U.S. PATENT DOCUMENTS 4,146,157 3/1979 Dixon, Sr. et al. .
4,503,992 3/1985 Sitko et al. .
4,582,214 4/1986 Dart et al. .
4,738,373 4/1988 DeParales .
4,795,052 1/1989 Hayes, Jr. ..... 220/713
4,898,299 2/1990 Herbst et al. .
4,915,250 4/1990 Hayes et al. ..... 220/713
5,385,255 1/1995 Varano et al. .
5,409,131 4/1995 Phillips et al. .
5,431,276 7/1995 Lialin .
5,460,286 10/1995 Rush et al. .
5,529,179 6/1996 Hanson .
5,542,670 8/1996 Morano ..... 220/714
5,586,676 12/1996 Lynd ..... 220/212
5,657,898 8/1997 Portman et al. ..... 220/712

*Primary Examiner*—Stephen K. Cronin
*Attorney, Agent, or Firm*—Barry E. Kaplan, Esq.; Hughes & Kaplan

[57] ABSTRACT

This patent discloses a detachable hot beverage cup lid. There is provided a spill resistant feature within the drink-through opening, a condiment funnel, an alignment indicia opposite the drink-through opening, and a novel stirring rod.

14 Claims, 2 Drawing Sheets

SPILL-RESISTANT CUP LID WITH CONDIMENT FUNNEL AND STIRRING ROD

RELATED APPLICATION

The inventors hereof claim priority under U.S. Provisional patent application Ser. No. 60/032,727, filed Dec. 14, 1996.

FIELD OF THE INVENTION

This invention relates generally to a spill-resistant lid for use with a beverage container, and, more particularly, to an improved spill-resistant lid for use with a hot beverage, like coffee, wherein condiments are commonly added. The present invention provides a spill-resistant lid having means for easy addition of condiments without the need to open or remove lid, and further provides a novel form of stirring rod for use with the spill-resistant lid.

BACKGROUND OF THE INVENTION

In recent years, the fast food service industry has experienced an explosion in growth. That growth has resulted in dramatically increased sales of take-out beverages. The industry has come to demand functional, convenient, inexpensive containers and lids for both hot and cold beverage service. Particularly relevant to the field of the present invention are lids required for use in hot beverage take-out service.

In order to supply such hot beverages to an increasingly mobile customer base, certain functional criteria must be considered in designing suitable hot beverage container lids. Successful designs have met the industry required criteria of being easily manufactured, being susceptible of compact storage for shipment and dispensing, and being inexpensive so as to be disposable following a one time use.

It has been observed, however, that certain other considerations have not been well met in the prior art. Specifically, on-the-go consumers are often concerned with the convenience, ease, and speed in adding condiments, such as sweeteners and creamers, to hot beverages such as coffee, tea, or the like. The industry and its consumers alike are concerned with ways to reduce or prevent the accidental injuries which often occur due to splashing or overturning of such hot beverages.

The design of such lids seemingly has been especially challenging, given that many hot beverages are served at drive-through windows. Wisely or not, consumers may attempt to add condiments to hot beverages while seated in a moving vehicle. Because contemporary hot beverage service lids provide limited access to the hot beverage for purposes of adding such condiments, consumers often remove the lid from the beverage container to add the desired condiments. It is often during this activity that injurious splashes or spills of the hot beverage occur.

Additionally, dripping of the hot beverage is a common experience. The source of such dripping is often attributable to insufficient sealing of the lid periphery against the rim of the cup. This is so because contemporary insulated paper cups are manufactured with a seam joining overlapping edges of the paper. This seam results in a step-type misalignment adjacent the surface of the cup. Because the rim of the cup is formed by rolling the upper edge thereof, the gap ultimately formed between the lid and the cup rim tends to increase. Depending upon the consumer's orientation of the cup when drinking, the resulting gap may result in dripping of the beverage from between the lid and the cup rim at the seam of the cup.

Recognizing this inconvenience, others have provided lid designs intended to increase the hoop strength of the lid. Examples of such designs may be found by referring to U.S. Pat. No. 5,460,286 to Rush et al. Such designs, even when effective, do not completely solve the problem so presented.

Further compounding the dripping problem, certain prior art lids remove the continuous seal between the cup and the lid adjacent the rim surface, as in those designs that utilize a "tear-back" tab portion of the cup lid. An example of such a design may be seen by referring to U.S. Pat. No. 4,738,373 to DeParales. The seal often is not reestablished well enough to prevent the hot beverage from leaking at the exposed junctures between the rim and the lid.

In addition, the "tear-back" tab portion of such a cup lid design may not stay firmly in its open position and can interfere with the consumer while drinking. Furthermore, the edges adjacent the "tear-back" tab portion which are left when the tear is effected can sometimes be sharp. These edges may feel uncomfortable to the consumer while drinking, and in some cases may cut the consumer's mouth.

Other inconveniences may be seen in referring to the prior art. Some lids, commonly referred to as "drink-through" cup lids, can be somewhat difficult for the consumer to drink from. The openings may be inconvenient, involving distortions of the lid from the user's mouth during drinking, as in U.S. Pat. No. 4,582,214 to Dart et al. Sometimes, the flow of the beverage allowed to pass through the openings may be substantially reduced, as in U.S. Pat. No. 4,898,299 to Herbst et al. The reduced beverage flow provided through some such lids may not be sufficient to satiate the consumer.

What is needed and apparently not heretofore available is a hot beverage cup lid which is effective in reducing the spills, splashes, and drips attendant to disposable hot beverage containers of the contemporary fast food service industry. The hot beverage cup lid should be effective in reducing such spills, splashes, and drips, without significantly impeding such flow of the beverage as the consumer may desire. Such a hot beverage cup lid should empty completely. Such a hot beverage cup lid, further, be susceptible of providing the consumer with the ability to safely and conveniently add desired condiments to a hot beverage without necessitating removal of the lid. Additionally, such a hot beverage cup lid should be comfortable to the consumer during use, attractive in design, inexpensive to manufacture, convenient to transport and store, and disposable.

It is the recognition of defects observed within the prior art hot beverage cup lids, combined with the recognition of those needs recited hereinabove, which has formed the objects and the basis for the present invention. It is, therefore, to the provision of such a hot beverage cup lid that the present invention is primarily directed.

SUMMARY OF THE INVENTION

The present invention comprises a hot beverage cup lid of the "drinkthrough" type, having a drink-through opening in the form of an arcuately shaped spout. The spout is located adjacent the upper peripheral rim of the hot beverage cup lid. The internal, substantially continuous peripheral edges of the drink-through opening depend inwardly toward the cup, so that fluid traveling adjacent the walls of the cup lid, as often occurs during vibration or shaking of the cup, is redirected and channeled down and away from the drink opening. The internal, substantially continuous peripheral edges of the drink-through opening allow the drink-through opening to be larger than prior art flat edge openings, so that beverage flow to the consumer is improved.

A condiment funnel is located at, or near, the center of the lid. A condiment funnel opening is provided which serves to channel excess beverage back into the cup, and through which condiments, such as cream or sweetener, may be poured into the cup. The funnel opening also acts to equalize the internal pressure within the cup when the consumer drinks through the cup lid. The funnel opening further acts to vent the cup lid of steam.

Also provided is a stirring rod with a hemispherically shaped flange or ball disposed near the upper portion of the rod. The hemispherical flange or ball rests in the condiment funnel opening and aids the consumer in stirring the beverage. The hemispherical flange also helps thermally seal the cup lid to decrease heat loss from the hot beverage. Optionally, the hemispherical flange or ball may contain a venting means, preferably in the form of a slit, should a higher degree of venting be required. Such an optional venting means further allows any excess beverage collected in the central funnel cavity, which otherwise would be trapped by the hemispherical flange of the stirring rod, to drain back into the container.

An aligning graphic, or indicia, is provided directly opposite the drink-through opening. When this indicia is disposed adjacent to the seam in paper-type cups, the resulting alignment of the cup lid with respect to the seam of the paper cup acts to reduce the drips due to the gap formed between the cup lip and the cup lid.

The usefulness of the present invention is enhanced by the wide variety and range of optional features which may be associated with it. Such optional features may include, but are not limited to: varied color; and, raised or bas-relief surface features of a variety of sizes, shapes, designs, patterns, characters, lettering, or any combination thereof.

Thus, one advantage of the hot beverage cup lid of the present invention is that it is effective in reducing the spills, splashes, and drips attendant to disposable hot beverage containers of the contemporary fast food service industry by providing a unique drink-through opening that resists accidental spilling, splashing, and dripping of a hot beverage. This is so because the present invention provides a contoured drinking spout, and further having internal, substantially continuous peripheral edges substantially surrounding the drink-through opening. These features, in combination, tend to impede travel of the hot beverage along the walls of the lid around the drink-through opening and to further redirect the beverage back into the container.

Another advantage of the hot beverage cup lid of the present invention is that it is effective in reducing spills, splashes, and drips, without significantly impeding such flow of the beverage as the consumer may desire. This is so because the internal, substantially continuous peripheral edges of the drink-through opening allow the drink-through opening to be larger than prior art flat edge openings, so that beverage flow to the consumer is improved.

Another advantage of the hot beverage cup lid of the present invention is that, in an optional configuration, it allows the consumer to completely empty the beverage container during use by providing at least one hole passing between the rim of the drink-through opening and the peripheral wall of the lid.

Another advantage of the hot beverage cup lid of the present invention is that it optionally may be provided with an aligning graphic, or indicia, that resists dripping from cups of the type which are manufactured with overlapping edges. This is so because the indicia is oriented in a position approximately 180° about the periphery of the lid with respect to the drink-through opening. When the indicia of the hot beverage cup lid is aligned adjacent to the overlapping edge, the seam, including the attendant gap formed between the lid and the cup rim, is opposite the direction of pouring of the hot beverage. Because little, if any, of the beverage is allowed to come into contact with the cup rim adjacent the gap, dripping through the gap is thereby minimized.

Another advantage of the hot beverage cup lid of the present invention is that it provides the consumer with the ability to safely and conveniently add desired condiments to a hot beverage without necessitating removal of the lid. This is so because the lid is provided with a central funnel, the funnel having an upper rim sufficiently large to intercept and contain a reasonable quantity of condiments being poured by the consumer thereinto. The funnel acts to direct the condiments towards a central opening which is sufficiently large to pass the condiments unobstructedly, and without clogging, into the beverage container. The funnel further serves to channel back into the container any beverage which may have passed through the funnel opening.

A further advantage of the present invention is that it provides a unique stirring rod for the hot beverage cup lid of the present invention. The stirring rod is provided with a ball or a hemispherical flange. The hemispherical flange is located along the axis of the stirring rod conveniently to serve its purpose, considering the depth of the cup. When the stirring rod is inserted through the central funnel opening, the hemispherical flange acts as a pivotal bearing surface to facilitate stirring of the beverage. When the stirring rod of the present invention is situated as described, its hemispherical flange further acts as a full or partial plug to resist splashing or spilling of the beverage through the central funnel opening, and to restrict the funnel opening against thermal losses. The hemispherical flange optionally may be provided with a venting means, preferably in the form of a slit. The venting means allows any excess beverage collected in the central funnel cavity, which otherwise would be trapped by the hemispherical flange of the stirring rod, to drain back into the container.

Yet another advantage of the present invention is that it is comfortable to the consumer during use, attractive in design, inexpensive to manufacture, convenient to transport and store, and disposable following its use.

Other objectives, features, and advantages of the present invention will become more fully apparent by reference to the following detailed description of the preferred embodiment, the appended claims, and the accompanying drawings.

BRIEF DESCRIPTION OF THE DRAWINGS

The present invention will be better understood by reading the Detailed Description of the Preferred Embodiment with reference to the accompanying drawing figures, in which like reference numerals denote similar structure and refer to like elements throughout, and in which.

DETAILED DESCRIPTION OF THE PREFERRED EMBODIMENT

In describing the preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figure 1:
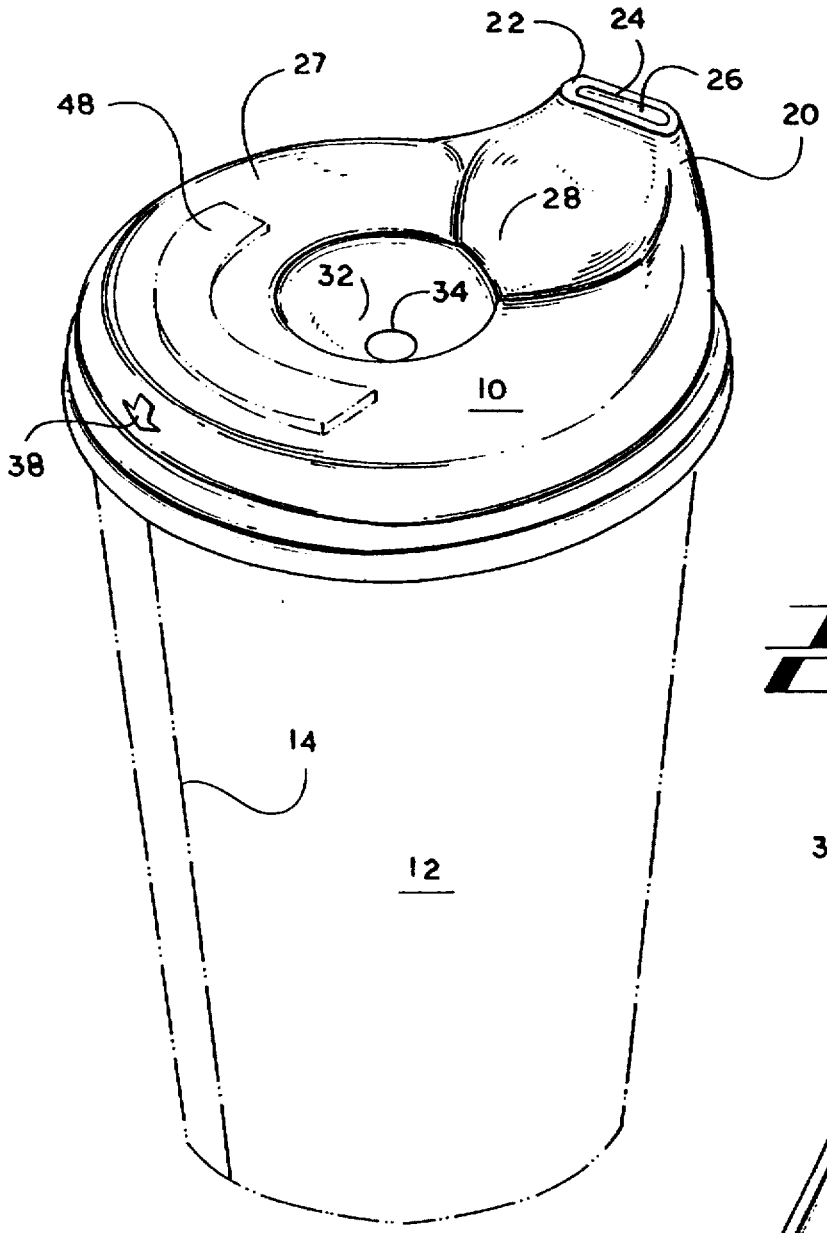
FIG. 1 is a perspective view of the typical cup lid of the present invention showing the central condiment funnel opening, raised drink-through opening, and an alignment indicia disposed adjacent to a paper cup seam.
Figure 2:
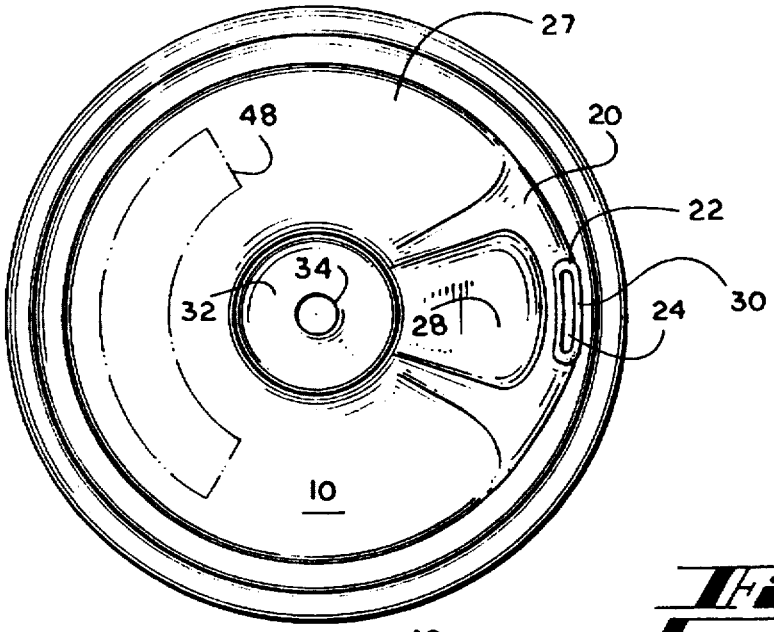
FIG. 2 is a top view of the present invention shown in FIG. 1.
Figure 3:
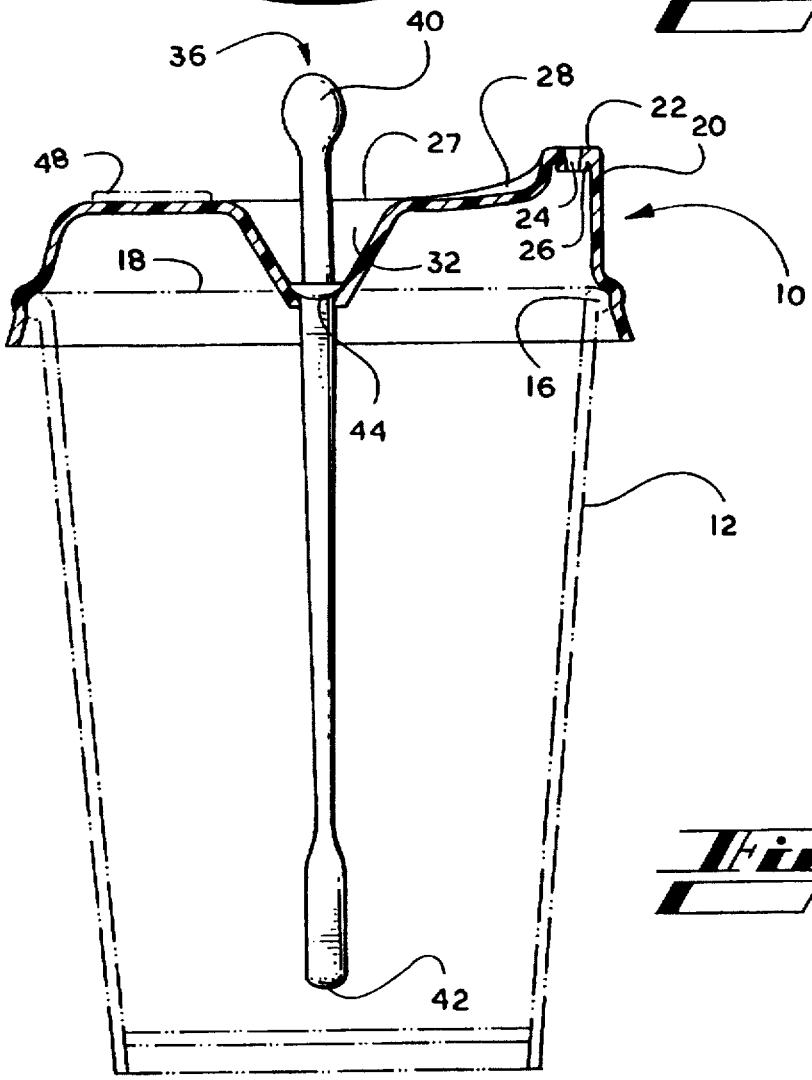
FIG. 3 is a cross-sectional view of the present invention shown in FIG. 1, taken along line I—I, showing the inwardly curved peripheral edges of the drink-through opening and the function of the ball or hemispherical flange mechanism of the stirring rod of the present invention.

Referring now to the drawing Figures, a preferred embodiment of the present invention is described in detail. Shown in FIGS. 1 through 3 is a drink-through cup lid (10) of the present invention. The cup lid (10) may be removably affixed to a disposable cup (12) well known in the art. Although cup (12) may be fabricated from any of a variety of popular materials, like polystyrene, coated or impregnated papers, and the like, the cup (12) shown in FIG. 1 is fabricated of treated paper. Cup (12) has a seam (14) formed during the manufacturing process by overlapping and sealing the paper edges. As best seen with reference to FIG. 3, cup (12) has a rolled lip (16) formed adjacent its open end (18).

The cup lid (10) includes at least three distinctive features. The first distinctive feature is a contoured spout (20) having at its top surface (22) a drink-through opening (24) disposed about the centerline of the spout (20). The contoured spout (20) is disposed adjacent the periphery of lid (10) and culminates in a substantially flat surface (22) disposed somewhat higher than the upper surface (27) of lid (10). The substantially flat surface (22) of spout (20) may be slightly angled, or tapered, toward the periphery of the lid (10) in order to more comfortably accommodate the consumer's mouth and to aid in directing the flow of the beverage. In the preferred embodiment of the present invention, the substantially flat surface (22) of spout (20) is disposed approximately one-fourth of an inch (¼") higher than the upper surface (27) of the lid (10), although it will be appreciated that this dimension may be adjusted to accommodate the proportions of a particular size of lid.

As can best be seen with reference to FIGS. 1 and 2, the contour of the spout (20) is such that an inwardly curved depression (28) is formed relative to the upper surface (27) of the lid (10). The advantage of the spout (20) formed in this manner is that the consumer's mouth may comfortably be disposed about spout (20) while drinking, whereby air is effectively sealed out.

As can best be seen with reference to FIG. 3, the drink-through opening (24) is formed with an internal, substantially continuous, downwardly depending surface (26). The advantage of the cup lid (10) of the present invention formed in this manner is that the internal, substantially continuous peripheral edges (26) of the drink-through opening (24) allow the drink-through opening (24) to be larger than prior art flat edge openings, so that beverage flow to the consumer is improved. The contoured spout (20), in combination with the internal, substantially continuous peripheral edges (26) of the drink-through opening (24), tend to impede travel of the hot beverage along the walls of the lid around the drink-through opening (24) and to further redirect the beverage back into the cup (12), as described more fully below.

As can be seen in FIG. 3, the internal, substantially continuous peripheral edges (26) about the drink-through opening (24) serve to help prevent the beverage from accidentally spilling through the drink-through opening (24). It has been observed that when a beverage is going to spill, most of the fluid tends to travel along the surface of cup (12) and lid (10). Unless the cup (12) is accidentally turned at an extreme angle, or upside-down, it is rare for the beverage to "slosh" directly upwards through the drink-opening (24) without contacting the internal surface of the cup (12) or lid (20). When the beverage does contact the surface of the cup (12) or lid (10), surface tension tends to keep it in contact therewith. When the beverage so traveling meets the peripheral edges (26) of the drink-opening (24), it is redirected back into cup (12). During normal drinking these peripheral edges (26) do not interfere with consumption of the beverage.

In an optional configuration, best seen by reference to FIG. 2, the lid (10) of the present invention allows the consumer to completely empty the beverage container during use by providing at least one small hole (30) passing between the rim of the drink-through opening (24) and the peripheral wall of the lid (10).

The second distinctive feature is a condiment funnel (32) formed substantially about the center of the lid (20). As can best be seen with reference to FIG. 3, the condiment funnel (32) depends downwardly from the upper surface (27) of the lid (10) toward the center of cup (12). The condiment funnel (32) concludes in a condiment funnel opening (34) disposed about the center of the lid (20).

In the preferred embodiment of the present invention, the diameter of the condiment funnel (32) adjacent the upper surface (27) of the lid (10) is approximately one inch (1"), and the diameter of the condiment funnel opening (34) is approximately three-sixteenths of an inch (3/16"), although it will be appreciated that these dimensions may be adjusted to accommodate the proportions of a particular size of lid and stirring implement.

The advantage of the condiment funnel (32) of the present invention formed in this manner is that it provides the consumer with the ability to safely and conveniently add desired condiments to a hot beverage without necessitating removal of the lid (10). This is so because condiment funnel (32) has an upper rim sufficiently large to intercept and contain a reasonable quantity of condiments being poured by the consumer thereinto. The funnel acts to direct the condiments towards the central funnel opening (34) which is sufficiently large to pass the condiments unobstructedly, and without clogging, into the cup (12). The condiment funnel (32) further serves to channel back into the cup (12) any beverage which may have passed through the condiment funnel opening (34).

The condiment funnel (32) serves several purposes. As can be seen in FIG. 3, the condiment funnel (32) allows a consumer to add condiments such as cream or sugar directly to a beverage while the cup lid (10) is attached to the cup (12). It also functions as a vent opening while the consumer is drinking, and it allows the use of a stirring rod (36). For the reasons described more fully above, it is rare for beverage to "slosh" directly upwards through the condiment funnel opening (34) at or near the center of the lid (10); therefore, the condiment funnel opening (34) can be large enough to accept condiments and a stirring rod (36).

Other cup lids only provide small diameter holes, or "pin-holes," to serve as vent holes or drain holes. These small openings often are not adequate and can serve to make the beverage pour out in an uneven flow. In other cases, these small openings may allow the beverage to pool in the cup lid because they are too small to return the beverage to the cup. This deficiency sometimes may result in the beverage spilling onto the consumer. As can be seen in FIGS. 1 and 2, the condiment funnel opening (34) of the present invention also serves to collect runoff beverage that may be left over from a drink, and to redirect it into the cup (12).

In addition, and with reference to FIG. 3, the condiment funnel (32) allows the consumer to keep his or her head level while drinking. This is so because, as the consumer drinks, the condiment funnel (32) allows the consumer's nose to protrude into and below the top of the lid (10). Prior-art devices disadvantageously require a consumer to tilt his or her head in order to drink the beverage when it drops below a certain level. Thus, the condiment funnel (32) so provided by the present invention is particularly useful in situations where the consumer needs to see where he or she is driving or walking, yet would like to drink at the same time.

The third distinctive feature is an alignment graphic or indicia (38). As best seen with reference to FIG. 1, the alignment indicia (38) is oriented in a position approximately 180° about the periphery of the lid with respect to the center of the drink-through opening (24). When the indicia (38) of the hot beverage cup lid (10) is aligned adjacent to the overlapping seam (14), the attendant gap formed between the lid (10) and the cup rim (18) is opposite the direction of pouring of the hot beverage. Thus, during normal use, the beverage will always be at a level below the gap. Because little, if any, of the beverage is allowed to come into contact with the cup rim (18) adjacent the gap, dripping through the gap is thereby minimized. It is contemplated that a manufacturer might also provide a similar alignment indicia adjacent the cup seam (14) to help users properly align the indicia (38) along the seam (14).

Figure 4:
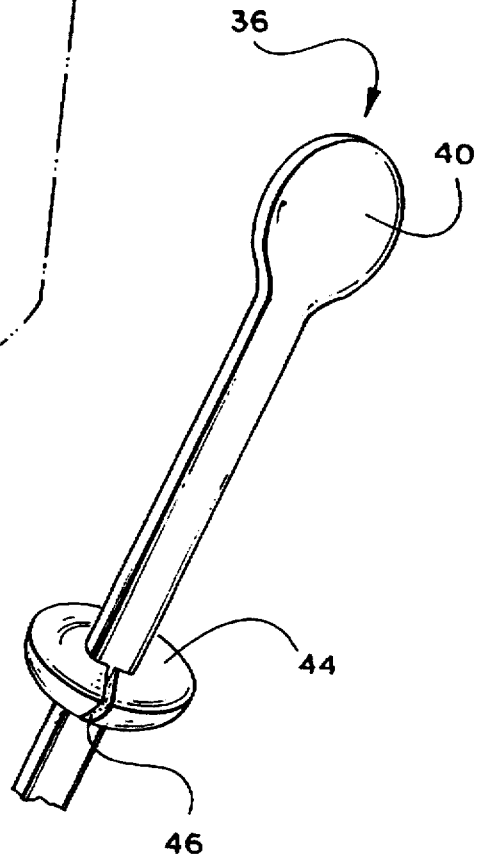
FIG. 4 is a perspective view of the upper third of the stirring rod of the present invention showing a hemispherical flange with a slit for venting of the condiment opening.

As best seen with reference to FIGS. 3 and 4, the preferred embodiment includes a stirring rod (36) having a first end (40) for grasping between the consumer's fingers. The stirring rod (36) tapers toward a second end (42) which is widened into a shape conducive to efficient stirring.

Stirring rod (36) is provided with a ball or a hemispherical flange (42). The hemispherical flange (44) is located along the axis of the stirring rod (36) conveniently to serve its purpose, considering the depth of the cup (12), but is typically approximately one-third of the length of the stirring rod (36) from the first end (40). When the stirring rod (36) is inserted through the central funnel opening (34), the hemispherical flange (44) acts as a pivotal bearing surface to facilitate stirring of the beverage. When the stirring rod (36) of the present invention is situated as described, its hemispherical flange (44) further acts as a full or partial plug to resist splashing or spilling of the beverage through the central funnel opening (34), and to restrict the funnel opening (34) against thermal losses.

The hemispherical flange (44) optionally may be provided with a venting means, preferably in the form of a slit (46). The venting means (46) allows any excess beverage collected in the central condiment funnel cavity, which otherwise would be trapped by the hemispherical flange (44) of the stirring rod (38), to drain back into the cup (12).

It will be appreciated that the cup lid (10) of the present invention may be provided with any form of design (48) conducive to the purposes of the merchant establishment. Such design (48) may, for example, take the form of a warning label or a trademark designation. Other optional features, including, but not limited to, aesthetically pleasing coloration, may be provided in conjunction with the present invention without departing from the scope of the invention.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments as illustrated herein, but is limited only by the following claims.

We claim:

1. A detachable cup lid for open-mouthed containers comprising:

a.) an upper cup lid surface, with an outer peripheral surface depending therefrom;

b.) a contoured spout disposed adjacent a peripheral edge of the cup lid, said contoured spout having an upper spout surface disposed higher in relationship to said upper cup lid surface;

c.) a depression formed adjacent said contoured spout in said upper cup lid surface;

d.) a drink-through opening substantially centered in said upper spout surface, said drink-through opening having at least one substantially continuous peripheral edge depending downwardly from said upper spout surface; and.

e.) a substantially conical condiment funnel adjacent the center of said cup lid, said condiment funnel depending downwardly from said upper cup lid surface, said condiment funnel further having a funnel opening.

2. The detachable drink-through cup lid of claim 1, wherein said condiment funnel opening is of indeterminate geometrical shape tapering to a hole at its bottom terminus.

3. The detachable drink-through cup lid of claim 1, wherein said condiment funnel opening is frangible to form a hole when pressure is applied thereto by a user.

4. The detachable drink-through cup lid of claim 1, wherein a hole is formed between said drink-through opening and said at least one substantially continuous peripheral edge, said hole being disposed adjacent said outer peripheral wall of said cup lid.

5. The detachable cup lid of claim 1 further comprising a stirring rod with a flange means disposed adjacent the longitudinal centerline of said stirring rod.

6. The stirring rod of claim 5 comprising a substantially hemispherical flange means.

7. The stirring rod of claim 5 comprising a substantially spherical flange means.

8. The stirring rod of claim 5 comprising a venting means.

9. The stirring rod of claim 8 comprising a slotted venting means.

10. The detachable cup lid of claim 1 further comprising a lid alignment indicia diametrically remote of said drink-through opening.

11. The detachable cup lid of claim 10 further comprising a beverage container having a seam and having an open end, whereby when said seam is substantially aligned with said lid alignment indicia, said beverage container seam is disposed diametrically remote of said cup lid spout, thereby tending to reduce dripping of a beverage between said lid and said seam when the combination is in use.

12. The detachable cup lid of claim 10 further comprising a beverage container having a seam and having an open end, said beverage container further comprising a cup alignment indicia disposed adjacent said open end, whereby when said cup alignment indicia is substantially aligned with said lid alignment indicia, said beverage container seam is disposed diametrically remote of said cup lid spout, thereby tending to reduce dripping of a beverage between said lid and said seam when the combination is in use.

13. In combination, a beverage container having a seam and having an open end, detachable cup lid for said beverage container comprising a spout disposed adjacent a peripheral edge of said cup lid, said cup lid further comprising a lid alignment indicia adjacent said peripheral edge, whereby when said seam is substantially aligned with said lid alignment indicia, said beverage container seam is disposed diametrically remote of said cup lid spout, thereby tending to reduce dripping of a beverage between said lid and said seam when the combination is in use.

14. The combination of claim 13 further comprising a cup alignment indicia disposed adjacent the open end of said beverage container, whereby when said cup alignment indicia is substantially aligned with said lid alignment indicia, said beverage container seam is disposed diametrically remote of said cup lid spout, thereby tending to reduce dripping of a beverage between said lid and said seam when the combination is in use.

* * * * *